United States Patent [19]

Erickson

[11] Patent Number: 4,722,116

[45] Date of Patent: Feb. 2, 1988

[54] REMOTE SETTING-CONTROL MECHANISM FOR A DOOR-CLOSER LATCH

[76] Inventor: Alvin L. Erickson, 9407 Domer Rd., Santee, Calif. 92071

[21] Appl. No.: 934,751

[22] Filed: Nov. 25, 1986

[51] Int. Cl.[4] ..... B05F 1/00

[52] U.S. Cl. ..... 16/49; 16/66

[58] Field of Search ..... 16/49, 50, 51, 66, 67, 16/68, DIG. 9, DIG. 10, DIG. 17; 49/137, 357

[56] References Cited

U.S. PATENT DOCUMENTS

| | | | |
|---|---|---|---|
| 340,143 | 4/1886 | Merredith | 16/66 |
| 592,233 | 10/1897 | Bowen | 16/67 |
| 1,241,478 | 9/1917 | Newec | 16/49 |
| 2,808,608 | 10/1957 | O'Hare | 16/70 |
| 2,930,070 | 3/1960 | Uebelhoer | 16/51 |
| 2,940,111 | 6/1960 | patriquin | 16/66 |
| 3,032,806 | 5/1962 | Mallory | 16/66 |
| 3,105,264 | 10/1963 | Truhon | 16/49 |
| 3,162,889 | 12/1964 | Runnels | 16/66 |
| 4,194,264 | 3/1980 | Stoffregen | 16/52 |

*Primary Examiner*—M. Jordan

*Attorney, Agent, or Firm*—Robert W. Beach; Ward Brown

[57] ABSTRACT

In a cantable latching plate type of door-closer latch, a backing plate is located at the side of the latch plate opposite the door-closer cylinder. Spring fingers normally hold the latch plate against the backing plate in unlatched position. A latch-setting cord extends from the backing plate to a location remote from the door-closer latch mechanism that can be pulled to shift the backing plate toward the door-closer cylinder for canting the latch plate relative to the door-closer piston rod into latched position.

13 Claims, 7 Drawing Figures

REMOTE SETTING-CONTROL MECHANISM FOR A DOOR-CLOSER LATCH

BACKGROUND OF THE INVENTION

1. Field of the Invention

This invention relates to a door-closer latch that can be set in different degrees of closing of the door selectively by manipulation of the latch mechanism from a location remote from such latch mechanism.

2. Prior Art and Problems Thereof

The general state of the prior art and problems inherent therein are well described in U.S. Pat. No. 3,162,889, issued Dec. 29, 1964, at column 1, lines 18 to 39, as follows:

> It is common practice to use a holding clip on the piston rod to maintain the open position of the door. This clip is essentially a ring surrounding the rod, and which engages the end of the cylinder at a point eccentric with respect to the rod axis. This point of engagement is usually determined either by providing a side extension on the clip which extends axially somewhat, or by using an eccentric boss or projection on the end of the cylinder as an abutment. The eccentric forces produce a rotation of the clip on an axis perpendicular to that of the rod, and jam the clip against axial movement. This action is sufficient to block retraction of the rod at the selected clip position. The clip is often set when one wishes to carry an armful of objects into the house, and does not wish to bother with opening the door.
>
> After the clip has performed its function, it is normally restored to the inactive position by moving the door open slightly, and manually slipping the clip along the rod to a point where the door can close fully without engaging the clip. This maneuver is sometimes difficult when one is wearing gloves, and obvious requires a return to the door to attend to this detail.

Clips of this general type are disclosed in the following patents:

U.S. Pat. No. 2,808,608, issued Oct. 8, 1957, shows a door check having a latch described as follows at column 3, lines 42 to 55:

> The L shaped clip 68 is provided with an aperture approximating the cross section of the stock used for the piston rod lever so that it may be slid end wise onto the latter during manufacture. A slight clearance relative to the lever member permits the clip 68 to be slideably positioned along the piston rod part thereof and the unperforated leg of the clip extending toward the end of the cylinder in bearing against the cylinder end cap 51 causes the apertured portion to cant and come into locking edge engagement with the piston rod, thereby holding the piston rod from inward movement into the cylinder to maintain the door at a selected open position.

The open position is selected by sliding of the clip 68 into the desired position along the piston rod, which sliding must be accomplished manually.

U.S. Pat. No. 2,930,070, issued Mar. 29, 1960, describes a door-closer latch at column 4, lines 49 to 74, as follows:

> To hold the associated door member in an open position, I provide stop means in the form of a plate 49 which can be generally oval in shape and carries a grommet 50 of cushioning material adapted to slidably receive piston rod 9. . . . One end 49′ of plate 49 is bent toward cylinder 1, and the other end thereof is bent away from the cylinder toward bracket 12, whereby when the door member 15 closes to a point where the inturned end 49′ engages cylinder 1, the plate 49, which normally assumes the position shown in broken lines in FIG. 6, will tilt or cant as shown in full lines therein, in a manner such as to bind on rod 9 and hold rod 9 and cylinder 1 against further relative movement. . . . When it is desired to permit the door member to move further toward closed position, plate 49 can be manually grasped and slid along rod 9 to another position.

Thus, the position at which the door member is to be held is selected by manually grasping the plate 49 and shifting it along the rod 9.

U.S. Pat. No. 3,032,806, issued May 8, 1962, describes the prior art at column 1, lines 11 to 22, as follows:

> In door closers employing a coacting cylinder and piston construction and cooperating spring means therefor, it is usual to apply to the piston road a specially formed washer-like element generally known as a "hold-open" washer which is slidably mounted on the piston rod and provided with an offset portion designed to engage that end of the cylinder through which the piston projects as to cause the washer to cant when it receives pressure exerted by the end of the cylinder, thus to bite against the piston rod and therefore when the piston rod has been withdraw from the cylinder to a desired degree, making it possible to hold the door open.

The hold-open washer of that patent is described more particularly at column 2, lines 45 to 51, as follows:

> the unit includes a hold-open washer 15 which is offset at 16 and 17 as a means for causing the washer to cant when positioned adjacent to the end 18 of the cylinder 10 to engage the piston rod 11 in biting engagement and restrain it from movement farther into the cylinder 10, when it is caused to project to a predetermined degree from the cylinder.

No mechanism is disclosed for positioning the washer adjacent to the end 18 of the cylinder 10, indicating that manual positioning is relied upon.

In U.S. Pat. No. 2,940,111, issued June 14, 1960, a door-closer latch is described at column 4, lines 22 to 33, as follows:

> The door to which my assembly is applied may be temporarily held in the open or partially open position by sliding the oversize washer 52 against the stud 53 projecting from the cap 21*a*, with the door in the position sought to be maintained.
>
> The closing biasing influence of the spring 35 is rendered inoperative to close the door by reason of the frictional canting and wedging of the washer 52 against the rod 19, caused by the pressure of the stud 53 against the washer 52. Release of the door is accomplished by further opening the door and thereafter sliding the washer away from the piston end of the rod 19.

No mechanism is shown or described for sliding the washer against the stud or sliding the washer away from the cylinder end so that, again, such sliding presumably can only be effected manually.

U.S. Pat. No. 3,105,264, issued Oct. 1, 1963, discloses latch mechanism for a door-closing door check at column 1, lines 26 to 32, as follows:

> The prior art hold-open means generally employed in spring loaded door closing door checks of the class hereinabove described have proved to be unsatisfactory because of the difficulties involved in making them operative to hold the door open and the inconvenience of releasing the hold-open means to release the door closing door checks for normal operation.

This patent then describes its latch at column 2, lines 32 to 34:

> The manually engageable quick release means 30 of the invention is preferably incorporated on the outer end of the said cylinder head 23.

The release means is then described in detail at column 3, line 7, to column 4, line 2, as follows:

> The short or stop end of the lever latch 31 is preferably bent to form a stop 311 which is of the correct length to hold the said lever latch 31 parallel to the outer end 231 of the cylinder head 23 when the said lever latch is rotated about the pivot pin 32 clockwise as viewed in FIG. 2. The long or operating end of the lever latch 31 is provided with an aperture 312 therethrough slightly larger in diameter than the diameter of the piston rod 22 so that the said piston rod 22 is free to reciprocate through the lever latch 31 when it is disposed in an unlatched position parallel to the outer end 231 of the cylinder head 23, see FIG. 2. The said long or operting end of the lever latch 31 extends a sufficient distance outwardly of the piston rod 22 to provide an operating tab 313.
>
> A spring loaded plunger 35 is reciprocatingly mounted in a suitable bore 233 in the cylinder head 23 below the lever latch 31 inwardly of the operating tab 313 thereof, which spring loaded plunger constantly urges the lever latch 31 to pivot clockwise as viewed in FIG. 1 to its unlatched position shown in FIG. 2. Thus, the lever latch 31 is normally disposed in its unlatched position shown in FIG. 2. . . .
>
> Accordingly, the door 11 may be releasably held in a partially open or substantially fully open position by the manually set quick release hold-open means 30 by the simple expedient of pressing the operating tab 313 of the hold-open lever latch 31 and releasing the door for closing by the door closing door check 10 while maintaining pressure on the said pressure tab 313. The hold-open means 30 immediately makes the door closing door check 10 inoperative until the hold-open lever latch 31 is released by manually pushing the door 11 ever-so-slightly toward its fully open position.

The latch of this patent must be set manually by pressing tab 313 and then manually maintaining pressure on the tab 313 to render the door check inoperative until the lever latch 31 is later released by opening movement of the door.

Presumably, U.S. Pat. No. 3,162,889 was describing in the excerpt quoted above deficiencies of the door-closer latches shown in these various earlier patents. The latch of U.S. Pat. No. 3,162,889 also, however, was required to be set manually, although it could be released simply by opening the door slightly, as in the case of U.S. Pat. No. 3,105,264 discussed above. Pat. No. 3,162,889 describes its improvement at column 1, lines 39 to 53:

> Applicant has provided a device for automatically moving the holding clip to inactive position simply in response to a slight push on the door to a more fully-opened position, with the added movement of the door being just sufficient to release the pressure between the end of the cylinder and the clip. Essentially, the performance of the device is based on the application of a continuing biasing force which is applied centrally on the clip, but of a sufficiently weak nature to be readily overcome by the eccentric jamming forces. As soon as these jamming forces are released by a slight initial opening movement of the door, however, the light central biasing forces proceed to produce a smooth axial movement of the clip along the rod ahead of the cylinder as the door moves to the closed position.

Although the clip can be released from latched position automatically, it still must be set in a particular latched position manually, as indicated in the description at column 2, lines 7 to 63:

> The door may be held in a fully or partially opened position by the use of the holding clip 17. This clip is essentially a washer surrounding the piston rod 11, with the extension 18 formed to engage the end 19 of the cylinder at a point eccentric from the axis of the rod 11. If the clip 17 is placed in a particular position along the rod when the door is open, and the door is then released, the first engagement with the clip 17 with the end 19 of the cylinder takes place at the extension 18. The forces at this point result in the generation of a moment which rotates the clip on an axis perpendicular to that of the rod. A jamming action thus develops which prevents axial movement along the rod. . . .
>
> As soon as the door is pushed a little further open from the position shown in FIG. 1, however, the jamming forces are released. The compressed spring 20 is therefore free to apply relatively central forces to the clip 17, and to produce a movement of the clip along the rod 11 to the left as shown in FIGS. 1 and 2 toward the bracket 15. . . . The spring 20 therefore pushes the clip ahead of it as the closing of the door proceeds.
>
> a slight opening movement of the door will result in the release of the forces applied to the extension 18, so that the resilience of compression of the washer 21 can move the clip 17 toward the bracket 15 without the generation of a jamming action. The setting of both the device shown in FIGS. 1 and 2 and that in FIG. 3 requires that a slight degree of manual force be applied to the clip to set the open position of the door, and compress the resilient member enough to bring the extension 18 into engagement with the cylinder end 19.

Despite the fact that the latch can be released automatically by slightly opening the door it is still necessary to apply manual force to the clip to set the door-closer latch for holding the door in a particular selected position.

A more complicated latch arrangement is disclosed in the much later U.S. Pat. No. 4,194,264, issued Mar. 25, 1980, which patent states at column 1, lines 11 to 17:

> Releasable latches presently known allow a door to be held fully open. . . . However such devices do not provide an auxiliary mechanism which will enable a door to be held in any selected intermediate or partially open position.

This latter statement is incorrect because the latch devices disclosed in U.S. Pat. Nos. 2,808,608; 2,930,070; 3,032,806; 2,940,111; 3,105,264; and 3,162,889 discussed above can latch door-closer mechanism to hold doors in various selected partially opened positions. It appears that the mechanism disclosed in Pat. No. 4,194,264 does not have that capability.

On the contrary, the latch mechanism of Pat. No. 4,194,264 can latch closer mechanism to hold the door in only one, slightly less than fully open position, as stated in column 3, lines 17 to 67:

> When door 90 is opened, cylinder 20 moves in the direction of arrow 102 as seen in FIG. 5. When cord 100 becomes taut, block 24 is pulled in the direction of arrow 104 within bracket 16 against the action of spring 36 causing follower 64 to move out of recess 58. Because of the configuration of spring member 14, follower 64 is biased to move in the direction of arrow 106 against side flange 53 adjacent ramp 60. During the opening of door 90, lever 70 slides along piston rod 23.
>
> On the release of door 90 to allow it to begin to move towards a re-closed position, cylinder 20 moves in the direction of arrow 108 as seen in FIG. 6, loosening cord 100 and allowing spring 36 to push block 24 in the direction of arrow 110 within bracket 16. . . . At the same time lever 70 is tilted, in the plane of piston rod 23, in the direction of arrow 112 by the movement of rod 28 and locks against piston rod 23 to prevent the door from closing. In this setting, door 90 will be held slightly less than fully open and spring 36 will be relatively uncompressed. However, spring 36 is not fully extended when lever 70 is locked on piston rod 23, thus imparting an additional force on the lever to maintain it in the locked position.
>
> To release door 90 from the position of FIG. 6 and allow it to close, lever arm 76 is depressed in the direction of arrow 114 as seen in FIG. 7, which releases lever 70 from locking engagement with piston rod 23 and allows the lever to slide along the piston rod, permitting the piston to move in relation to cylinder 20. Also the depression of lever arm 76 moves rod 28 in the direction of arrow 116 to fully depress spring 36 (as in FIG. 5) and move block 34 in the direction of arrow 118, causing follower 64 to move along inclined leading edge 54 of shoulder 52 in the direction of arrow 120. Because of the bias of follower 64 it returns to its position of rest in recess 58 in trailing edge 56 of shoulder 50. Shoulder 52 ensures that follower 64 does not overshoot recess 58 on the return to its position of rest.
>
> Alternatively, door 90 may be released from the open position by opening the door fully, from the slightly less than fully open position of FIG. 6, which will release lever 70 from locking engagement with piston rod 23, as in FIG. 5. As a further alternative, the release of door 90 from the position of FIG. 6 may be effected by pushing knob 48 to move rod 28 and release lever 70 from locking engagement with piston 92.

Thus, while the mechanism shown in U.S. Pat. No. 4,194,264 can be latched in one preselected position depending upon the length of cord 100, there does not appear to be any suggestion for latching the closer mechanism to hold the door in different selected, partially open positions.

The problem of previous door-closer latches of the tilting latch plate type to which the present invention relates are principally two. The first problem is that, as discussed with respect to the patents other than U.S. Pat. No. 4,194,264, the latch mechanism must be set manually by directly manipulating the latch plate. Such requirement is not a particular disadvantage when the door closer is mounted elevationally near the center of the door, as shown in FIG. 5 of U.S. Pat. No. 3,105,264, but the problem is greatly aggravated when the door closer is mounted at the top of the door as shown in FIG. 1 of U.S. Pat. No. 2,940,111, as it frequently is.

The second problem is that, even if the door-closer latch mechanism can be set automatically, as disclosed in U.S. Pat. No. 4,194,264, such latch mechanism is deficient if it cannot enable the door-closer mechanism to be latched with the door in different selected degrees of opening. When a person desires to carry an arm full of objects into the house and does not wish to bother with opening the door, as discussed in U.S. Pat. No. 3,162,889, as quoted above, the door closer may be latched with the door in substantially fully open position. It may, however, be desirable to latch the door closer for holding the door in only slightly open position such, for example, as to enable a cat or a dog to have ingress to and egress from the building while having the door closed as far as possible.

SUMMARY OF THE INVENTION

It is a principal object of the present invention to provide latch mechanism for a door closer which will enable the door closer to be latched while holding the door in different selected degrees of opening and that can be operated easily from a convenient location remote from the door closer.

Another object is to provide latch mechanism of simple and economical construction which is rugged and reliable in operation.

An additional object is to provide latch mechanism in the form of a conversion or accessory unit that can be applied to various prior art door closers without altering the construction of such door closers.

In connection with the last-mentioned object, it is a further object to enable such conversion or accessory latch units to be installed quickly and easily by a person having little mechanical skill.

Also, it is an object to provide latch mechanism which can be supplied in kit form for installation on door-closer mechanisms.

The foregoing objects can be accomplished by providing a backing plate for a door-closer latch plate, which backing plate is mounted on the door-closer cylinder adjacent to but spaced from one end of such cylinder with the latch plate between such backing plate and the door-closer cylinder with spring fingers normally holding the latch plate against the backing plate in unlatched position and which backing plate can be moved toward the door-closer cylinder by a pull on a latch-setting cord at a location remote from the door closer which will tilt the latch plate into door-closer latching position.

DETAILED DESCRIPTION

Figures 1, 2, 3, 4, 5, 6, 7:
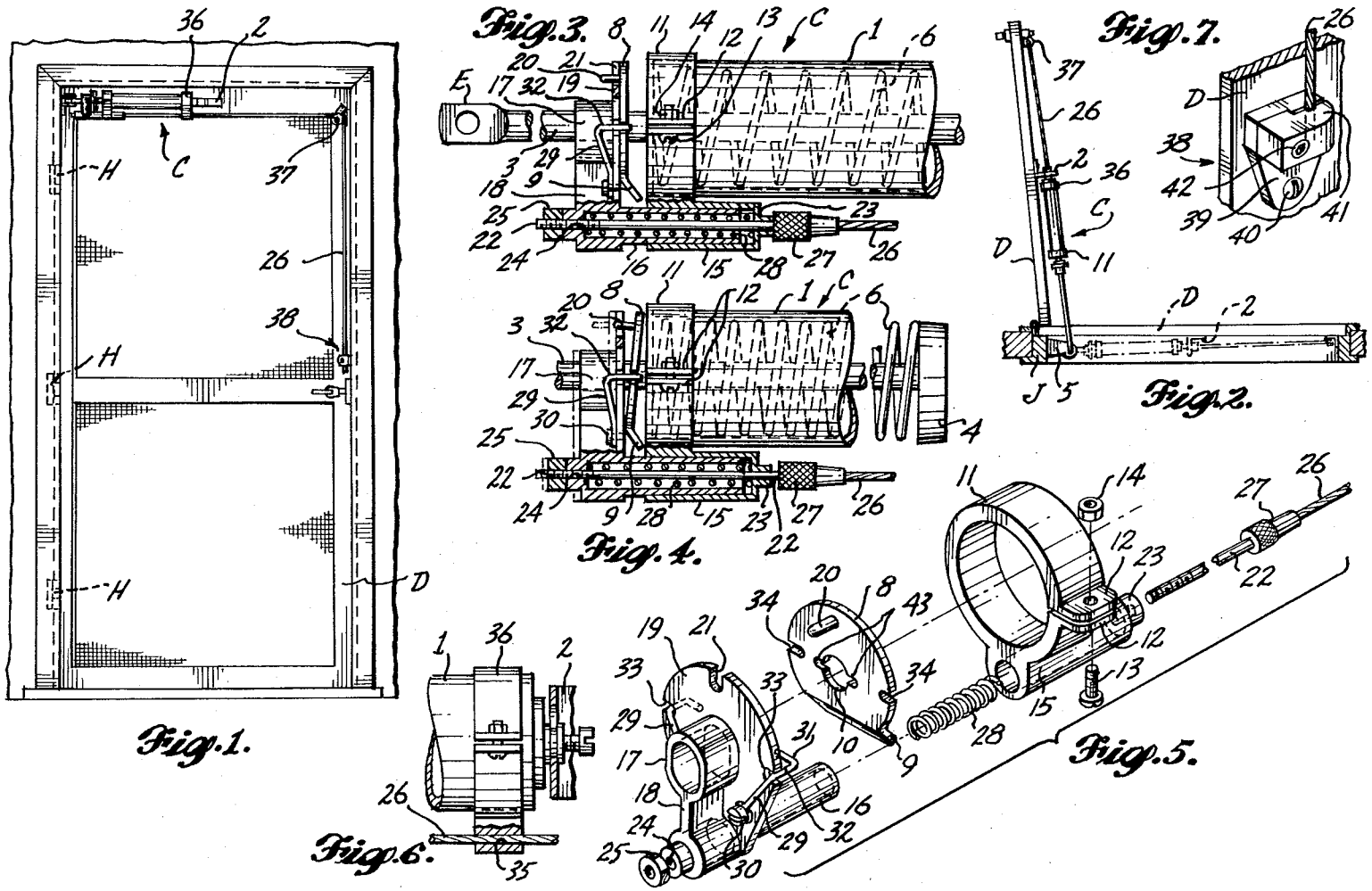
FIG. 1 is an elevation showing an installation on a screen door of a door closer equipped with the door-closer latch mechanism of the present invention.
FIG. 2 is a plan of such a door installation.
FIG. 3 is an elevation of an end portion of a door closer equipped with the latch mechanism of the present invention, with parts broken away and showing parts in one operative position.
FIG. 4 is a similar view showing parts in a different operative position.
FIG. 5 is a top perspective of a portion of the door-closer latch mechanism of the present invention showing parts in exploded relationship.
FIG. 6 is a side elevation of another portion of the latch mechanism with parts broken away.
FIG. 7 is a top perspective of still another portion of the latch mechanism.

FIGS. 1 and 2 show a typical installation of a screen door D mounted on hinges H for swinging between the solid line position and the broken line position shown in FIG. 2. Closing of such door is checked and complete closing of the door is effected in a controlled manner by the conventional door closer C installed on the top rail of the screen door, as shown in FIG. 1.

As indicated in FIGS. 3, 4 and 6, the conventional door closer C includes a cylinder 1 having one end secured by a bracket 2 to the top rail of the screen door D and a piston rod 3 extending into the opposite end of the cylinder and carrying piston 4. Such one end of the cylinder has a head that can pass through the larger circular arcuate portion of a keyhole or notched hole slot in the bracket 2 so that an annular groove behind the head can fit into the reduced circular arcuate notch portion of the keyhole slot to anchor such cylinder end as shown, for example, in FIGS. 1, 4 and 5 of U.S. Pat. No. 2,808,608 and described at column 3, lines 18 to 37. Alternatively, the notch could be under and extend downward from the larger circular arcuate portion of the slot. The end of the piston rod remote from cylinder 1 is secured by a bracket 5 to the doorjamb J. A helical coil spring 6 received within the cylinder 1 encircling piston rod 3 reacts between the cylinder and the piston for exerting a force tending to draw the piston rod 3 into the cylinder for moving the door D toward closed position.

The door closer normally holds the door D in the broken line closed position shown in FIG. 2. As the door is swung from the closed position shown in broken lines toward the open position shown in full lines, a piston rod 3 is drawn outwardly of the cylinder 1 because of the difference in distance between the brackets 2 and 5 in their broken line positions of FIG. 2 and the greater distance between the brackets in their full line positions. Such withdrawing of the piston rod from the cylinder pulls piston 4 toward the end of cylinder 1 closer to bracket 5, from the condition shown in FIG. 3 toward the condition shown in FIG. 4, so that the piston 4 compresses spring 6. If the door closer has no latch, when the door is released the force of compressed spring 6 will contract the door closer by drawing piston rod 3 inwardly of the cylinder 1 to swing the door D closed. By providing proper bleed apertures in the cylinder 1, such closing movement of the door D will be effected at a controlled rate.

If it is desired to hold the door open in some selected position in opposition to the action of the door closer, a latch can be provided for the door closer. Such latch includes a tiltable or cantable latch plate 8 having a bent toe 9 and a central aperture 10 of a size to fit loosely on piston rod 3. Engagement of the end of cylinder 1 with the bent toe 9 will tilt the latch plate 8 into a position canted relative to the piston rod 3 so that the edges of aperture 10 will bite into opposite sides of the piston rod to grip it for holding the cylinder 1 against further movement along the piston rod by the force exerted by spring 6 between the cylinder and the piston 4. Such portion of the latch structure is conventional as illustrated by prior patents discussed above.

The latch mechanism of the present invention is carried by the cylinder 1 by a latch-mounting split clamp band 11 of a size to fit snugly over one end of the cylinder 1, as shown in FIGS. 3 and 4. Such band has radially projecting ears 12 that are apertured to receive a bolt 13 on which a nut 14 can be screwed. Tightening of such bolt will draw the ears 12 together to tighten the clamp 11 on the cylinder.

Clamp band 11 carries a sleeve 15 projecting radially from one side of it that receives within it a tele- scoping tube 16 supporting a collar 17 by a web 18 extending radially of such telescoping tube. The collar 17 has through it an aperture of sufficient size to receive the piston rod 3 extending through it loosely. Such collar carries a backing plate 19 which preferably is generally circular and has a central aperture coinciding with the aperture of collar 17 through which the piston rod 3 also passes.

Latch plate 8 has a pin 20 projecting parallel to piston rod 3 toward the backing plate 19 at a location offset from its center for reception in a notch 21 in the periphery of the backing plate. Engagement of pin 20 in notch 21 will prevent appreciable angular displacement of latch plate 8 relative to backing plate 19 about the axis of piston rod 3 without preventing relative tilting of such plates about an axis extending parallel to such plates and perpendicular to the piston rod.

A connecting rod 22 extends through the collar formed by neck 23 projecting from the end of sleeve 15 remote from the latch plate 8 and then through such sleeve and the telescoping tube 16 within it beyond the opposite end of such telescoping tube. The end of rod 22 remote from neck 23 is threaded for screwing through an internally threaded aperture 24 in the end of telescoping tube 16 remote from neck 23. The rod 22 can be secured in a desired position adjusted lengthwise of telescoping tube 16 by a locknut 25 screwed onto the threaded end of such rod projecting beyond the threaded aperture end of telescoping tube 16.

One end of a control cord or line 26 is attached to the end of rod 22 adjacent to neck 23 by a connector 27 that may be an internally shouldered sleeve receiving the knotted or enlarged end of the cord 26 and having a bore threaded onto the rod 22 or otherwise secured on such rod such as by soldering. Thus rod 22 connects the control cord 26 to the backing plate 19 carried by tube 16.

Within the telescoping tube 16 and surrounding the connecting rod 22 is a helical compression spring 28 having one end bearing against the inner end of sleeve 15 that carries neck 23 and the other end bearing against the remote end of telescoping tube 16 for exerting a force tending to slide the telescoping tube out of the sleeve. Such outward movement is limited by the connector 27 engaging neck 23 and by the opposite threaded end of rod 22 secured in the opposite end of telescoping tube 16. The position in which the threaded end of rod 22 is secured in the end of telescoping tube 16 will establish the limiting position of movement of backing plate 19 away from cylinder 1, as illustrated in FIG. 3.

When the backing plate 19 is in its position farthest from cylinder 1, as shown in FIG. 3, the latch plate 8 is normally retained in a position contiguously engaging the backing plate in face-to-face relationship, as shown in FIG. 3, by balanced wire spring fingers 29. Such fingers are mounted, respectively, on opposite sides of the backing plate 19 by mounting screws 30 and are disposed at opposite sides of the collar 17. Such spring fingers carry hooks 31 extending radially inward beyond diametrically opposite portions of the backing plate 19 at the side adjacent to the latch plate 8. Such hooks are connected to the shank portions of the wire-spring fingers by connecting portions 32 that fit loosely in notches 33 in diametrically opposite edge portions of the backing plate 19. Such connecting portions of the wire-spring fingers also engage in edge notches 34 in diametrically opposite portions of the latch plate 8 so that the spring-finger hooks 31 will be located at the side of latch plate 8 opposite the backing plate 19, as shown in FIG. 3. Engagement of such hooks with the latch plate will hold it against the backing plate in a position perpendicular to the piston rod 3 so that the latch plate will not latch the closer to the piston rod as long as the latch plate is held in that position.

The cord 26 is the control cord for effecting latching action of the latch 8 in any desired, partially open position of the door D. Such control cord extends from the connector 27 through a fairlead 35 mounted on the end of cylinder 1 remote from the latch mechanism by a band clamp 36. From the fairlead 35 the control cord extends along the upper rail of the door to a guide pulley 37 mounted at the top of the swinging edge portion of the door, as shown in FIGS. 1 and 2. From such guide pulley the control cord extends downwardly along the swinging edge of the door to the elevationally central portion of the door elevationally. The end of the control cord is anchored to the swinging marginal portion of the door at that location by a clamp 38.

Clamp 38 includes an anchor part 39 secured to the door margin by a bolt 40. A clamping bar 41 is secured to the anchor part 39 by a clamp screw 42.

Unless the latch plate 8 is intentionally set in latching position, the door D can be swung open or closed without risk of it being retarded or latched by the latch plate 8 gripping the piston rod 3. Such plate is held in the position shown in FIG. 3 in contiguous face-to-face engagement with the backing plate 19 by the balanced force of the opposite spring fingers 29. When it is desired to set the latch to hold the door D in any desired degree of opening, it is only necessary to deflect the latch-operating control cord 26 slightly at a location adjacent to the clamp 38. Such portion of the control cord is within easy reach of a person opening the door even though the door closer C is mounted on the top rail of the door, as shown in FIG. 1. Such deflection of the cord will pull the end of the cord connected to the rod 22 slightly to the right as seen in FIG. 4 to shift backing plate 19 to the right correspondingly. Such movement will cause the backing plate 19 to press the latch plate 8 toward the cylinder 1 so that the bent toe 9 of the latch plate will be pressed into engagement with the adjacent side of the band clamp 11 carrying the sleeve 15, as shown in FIG. 4.

Pressure of the backing plate 19 against the bend between the toe 9 and the latch plate 8 will tilt the latch plate relative to the backing plate in opposition to the light force of the spring fingers 29 so that the latch plate aperture will grip the piston rod 3 in canted latching position, as shown in FIG. 4. When the control cord is released, the spring 28 will shift the telescoping tube 16 and backing plate 19 away from the closer cylinder 1 from the position shown in FIG. 4 to the limiting position shown in FIG. 3, but the latch plate 8 will remain in the latched position shown in FIG. 4 because the force exerted on such latch plate by spring fingers 29 tending to move the latch plate into contiguous face-to-face engagement with the backing plate 19 will not be sufficient to overcome the resistance to movement of the latch plate along piston rod 3 effected by edges of the latch plate central aperture 10 biting into opposite sides of the piston rod 3.

When it is desired to release the latch mechanism from its canted latched position of FIG. 4, it is only necessary to swing the door D slightly farther open which will move backing plate 19 again into engagement with the bend between the main portion of latch plate 8 and the toe 9. By such farther opening movement of the door, the cylinder 1 of the door closer will have been withdrawn somewhat from the toe 9 so that pressure of the backing plate on the bend of the latch plate will swing it from canted latched position toward unlatched position perpendicular to piston rod 3 and in contiguous face-to-face engagement with the backing plate 19. The force of spring fingers 29 will assist in moving the latch plate into the unlatched position shown in FIG. 3. The door D may then again be swung free of the latching mechanism between open and closed positions until the latch is reset in the manner described above.

The latch mechanism includes the parts shown in exploded relationship in FIGS. 5, 6 and 7. These parts can compose a latch kit to be supplied for new installation with the door closer C, or such kit can be supplied as a retrofit accessory for installation on a door closer C previously installed on a door.

The piston rod 3 may have on its end a flattened eye E which is wider than the diameter of the piston rod, as is the case with the piston rod 11 shown in FIG. 4 of U.S. Pat. No. 3,032,806, for example. To enable a latch plate 8 to be slid over such an eye onto the piston rod diametrically opposite internal notches 43 shown in FIG. 5 may be provided extending radially outwardly from the central aperture 10. Also, the aperture in collar 17 can be elongated to enable such collar to be slid over such a piston rod eye.

To install the door-closer latch of the present invention, the band clamp 11 can be slid over the end of cylinder 1 which will be nearer the doorjamb when the door closer is mounted and secured in place by tightening the clamp bolt 13, 14. Next, the latch plate 8 is slid over the piston rod with its toe 9 bent toward the end of cylinder 1 carrying band clamp 11. The backing plate 19 is then assembled on the piston rod with such rod extending through collar 17 and with telescoping tube 16 being inserted into sleeve 15 with spring 28 received within the telescoping tube. The latch finger connecting portions 32 can now be pulled radially outward so that hooks 31 will pass through notches 34 in the latch plate 8 and engage the side of such latch plate opposite the backing plate 19. Then the rod 22 is inserted through the sleeve 15 and telescoping tube 16, screwed into the threaded aperture 24 of the telescoping tube and secured in place by the locknut 25 to connect the backing plate 19 and the latch-operating cord 26.

The fairlead band clamp 36 is assembled over the end of cylinder 1 remote from band clamp 11 with its fairlead 35 aligned with the telecoping tubes 15 and 16 and the control cord 26 is passed from the connector 27 thrugh the fairlead. After the door closer has been mounted on the door and jamb as shown in FIGS. 1 and 2, the control cord 26 extending through the fairlead 35 is engaged with the guide pulley 37 and secured to the swinging margin of the door by the clamp 38.

The position in which connecting rod 22 is threaded into the telescoping sleeve threaded end 24 can be adjusted so that the latch mechanism can be set and released satisfactorily. The rod can be locked relative to the backing plate 19 in that position by the locknut 25.

I claim:

1. A method of setting a latch plate in a latched position relative to the piston rod of a door closer which comprises pulling on a portion remote from a backing means of a control cord attached to the backing means and thereby pressing the backing means against the latch plate to cant it toward latched position.

2. Remote setting-control mechanism for a door-closer latch for a door closer mounted on the upper margin of a door having hinge means supporting an edge portion of the door for swinging of the door about an upright axis and the door closer including a piston rod, such latch including a plate having an aperture through which the piston rod projects and tiltable relative to the piston rod into canted jammed latched position relative to the piston rod, the improvement comprising control means for effecting setting of the latch plate in canted latched position relative to the piston rod including a pull cord and means guiding said pull cord across the upper margin of the door away from the hinged edge of the door and downward along the swinging edge of the door.

3. The mechanism defined in claim 2, including holding means carried by the door generally centrally elevationally of the door and holding the lower end of the pull cord.

4. Control mechanism for an apertured latch plate of a door closer having a piston rod extending through such latch plate aperture comprising backing means carried by the door closer, spaced from the door closer and located adjacent to the latch plate, and moving means for shifting said backing means relative to the latch plate for effecting setting of the latch plate in canted latched position relative to the piston rod.

5. The mechanism defined in claim 4, in which the moving means includes a latch-setting pull cord.

6. The mechanism defined in claim 5, a door, hinge means supporting one edge of the door for swinging of the door about an upright axis, means mounting the door closer on the upper margin of the door, and guide means guiding the latch-setting pull cord downward from the upper portion of the door.

7. The mechanism defined in claim 5, a door, hinge means supporting one edge of the door for swinging of the door about an upright axis, means mounting the door closer on the upper margin of the door, and guide means guiding the latch-setting pull cord downward from the upper portion of the door, said guide means including a fairlead supported on the door closer at a location remote from the latch means.

8. The mechanism defined in claim 7, and clamp means mounted on the door and clamping the lower end of the pull cord.

9. The mechanism defined in claim 7, in which the guide means includes means for guiding the pull cord from the door closer to a location adjacent to the swinging edge of the door and downward along the swinging edge of the door to a location elevationally generally centrally of the door.

10. The control mechanism defined in claim 4, and spring means normally pulling the latch plate toward and holding it against the backing means.

11. The control mechanism defined in claim 10, the spring means including spring fingers contacting the latch plate at substantially diametrically opposite locations.

12. The control mechanism defined in claim 4, the moving means including telescoping tubes and compression spring means within said tubes exerting a force tending to extend said tubes.

13. The control mechanism defined in claim 12, and means for adjusting the telescoping tubes to alter the distance between the backing means and the door closer when the telescoping tubes are in their fully extended position.

* * * * *